US006530996B2

(12) United States Patent
Värpiö

(10) Patent No.: US 6,530,996 B2
(45) Date of Patent: Mar. 11, 2003

(54) METHOD FOR WASHING ITEMS

(75) Inventor: Timo Värpiö, Tampere (FI)

(73) Assignee: Fuuga-Controls Oy, Tampere (FI)

( * ) Notice: Subject to any disclaimer, the term of this patent is extended or adjusted under 35 U.S.C. 154(b) by 0 days.

(21) Appl. No.: 09/897,905

(22) Filed: Jul. 5, 2001

(65) Prior Publication Data

US 2002/0020435 A1 Feb. 21, 2002

Related U.S. Application Data

(60) Provisional application No. 60/218,635, filed on Jul. 13, 2000.

(51) Int. Cl.[7] ..... B08B 1/02; B08B 3/00; B08B 9/20

(52) U.S. Cl. ..... 134/18; 134/25.1; 134/25.2; 134/26; 134/32; 134/57 R; 134/72

(58) Field of Search ..... 134/18, 25.1, 25.2, 134/26, 32, 57 R, 72

(56) References Cited

U.S. PATENT DOCUMENTS 4,357,176 A * 11/1982 Anthony ..... 134/18
4,561,904 A * 12/1985 Eberhardt, Jr. ..... 134/18

* cited by examiner

*Primary Examiner*—Zeinab El-Arini
(74) *Attorney, Agent, or Firm*—Oliff & Berridge, PLC

(57) ABSTRACT

A method for washing items using an apparatus including at least one conveyor, at least one washing zone, and at least one rinsing zone, items to be washed are guided through the washing apparatus in succession in the process direction of the apparatus and sprayed with a washing fluid in a washing zone and with rinsing water in a rinsing zone. The items to be washed are of different types distinguishable from one another, their types being distinguished by identifying sensors arranged to the washing apparatus. On the basis of the identification a control item of the washing apparatus automatically selects the appropriate washing and/or rinsing programme for the item concerned.

8 Claims, 1 Drawing Sheet

METHOD FOR WASHING ITEMS

This nonprovisional application claims the benefit of U.S. Provisional Application No. 60/218,635, filed Jul. 13, 2000.

BACKGROUND OF THE INVENTION

The present invention relates to a method for washing items in an automated washing apparatus comprising at least one conveyor, at least one washing zone and at least one rinsing zone, the items to be washed being guided in succession through the washing apparatus in the process direction of the apparatus and sprayed with washing fluid in the washing zone and with rinsing water in the rinsing zone.

The invention further relates to an automated washing apparatus for washing items, the apparatus comprising at least one washing zone, at least one rinsing zone, at least one conveyor for moving the items through the washing apparatus in the process direction of the apparatus, feeder means for feeding washing fluid to the washing zone, nozzles for spraying rinsing water to the rinsing zone, and a control item for controlling the washing apparatus.

Restaurants, hotels, hospitals and other large facilities use automated wash lines for washing large amounts of dishes. The dishes to be washed are usually placed into racks which are arranged onto a conveyor and the conveyor, which is equal in length to the washing apparatus, carries the racks and the dishes through the wash line. In what is known as a fly type conveyor apparatus, the dishes are placed onto the conveyor itself, the surface of the conveyor being provided with pin-like projections or recesses to hold the dishes in place during the wash. A wash line usually consists of a prewash for rinsing off bigger impurities, followed by a main wash and a rinse.

It is common knowledge that different dishes or dishes used for different purposes usually require a different kind of wash. For example, dishes used for cooking, such as kettles or pans, require a considerably greater amount of washing than cutlery, for example. To ensure a sufficient wash result for all types of dishes, the wash and rinse programmes of the washing apparatus must be set according to the dishes that are the most difficult to wash. This means that excessive amounts of energy, water and chemicals are consumed for less dirty dishes, which causes unnecessary costs.

BRIEF SUMMARY OF THE INVENTION

It is an object of the present invention to provide a novel arrangement for washing racks in an automated washing apparatus.

The method of the invention is characterized in that there are different types of items to be washed, distinguishable from one another, and that said types are identified using identifying sensors arranged to the washing apparatus, the result of the identification allowing a control item of the washing apparatus to automatically select the appropriate wash and/or rinse programme for the item concerned.

The washing apparatus of the invention is characterized in that the washing apparatus is arranged to carry out the washing of items to be washed, which items are of different types distinguishable from one another and that said types are arranged to be identified with identifying sensors arranged to the washing apparatus, and that the result of the identification allows a control item of the washing apparatus to select the appropriate wash and/or rinse programme for the item concerned.

An essential idea of the invention is that the types of the items to be washed can be distinguished from one another, that the types are identified using identifying members arranged to the washing apparatus, and that on the basis of the identification, the control item of the washing apparatus automatically selects the appropriate wash and/or rinse programme for use for the item concerned. In addition, an idea of a preferred embodiment of the invention is that the washing apparatus is operated in cycles comprising an operating period and a pause period, during which operating period washing fluid and rinsing water are fed to the washing apparatus and the items to be washed are conveyed in the process direction of the apparatus, and during which pause period the conveyance of the items is brought to a halt and the feeding of rinsing water to the rinsing zone is interrupted. An idea of a second preferred embodiment is that the item to be washed is a rack into which the dishes to be washed are arranged. Further, an idea of a third preferred embodiment is that the racks are provided with an identifier identifiable by identifying sensors, and that a separate wash and/or rinse programme is programmed into the control item of the apparatus for each rack type for washing and/or rinsing the rack in question and the dishes arranged into the rack.

An advantage of the invention is that wash parameters, such as prewash time, main wash time, rinse time, the chemicals to be used and their amount, and other similar parameters can be set so that the item to be washed in question will be washed in an optimal manner, with regard to both the costs of operation and the wash result.

BRIEF DESCRIPTION OF THE DRAWING

In the following the invention will be described in greater detail in connection with accompanying FIG. 1 which is a schematic view of the washing apparatus of the invention.

DETAILED DESCRIPTION OF THE INVENTION

Figure 1:
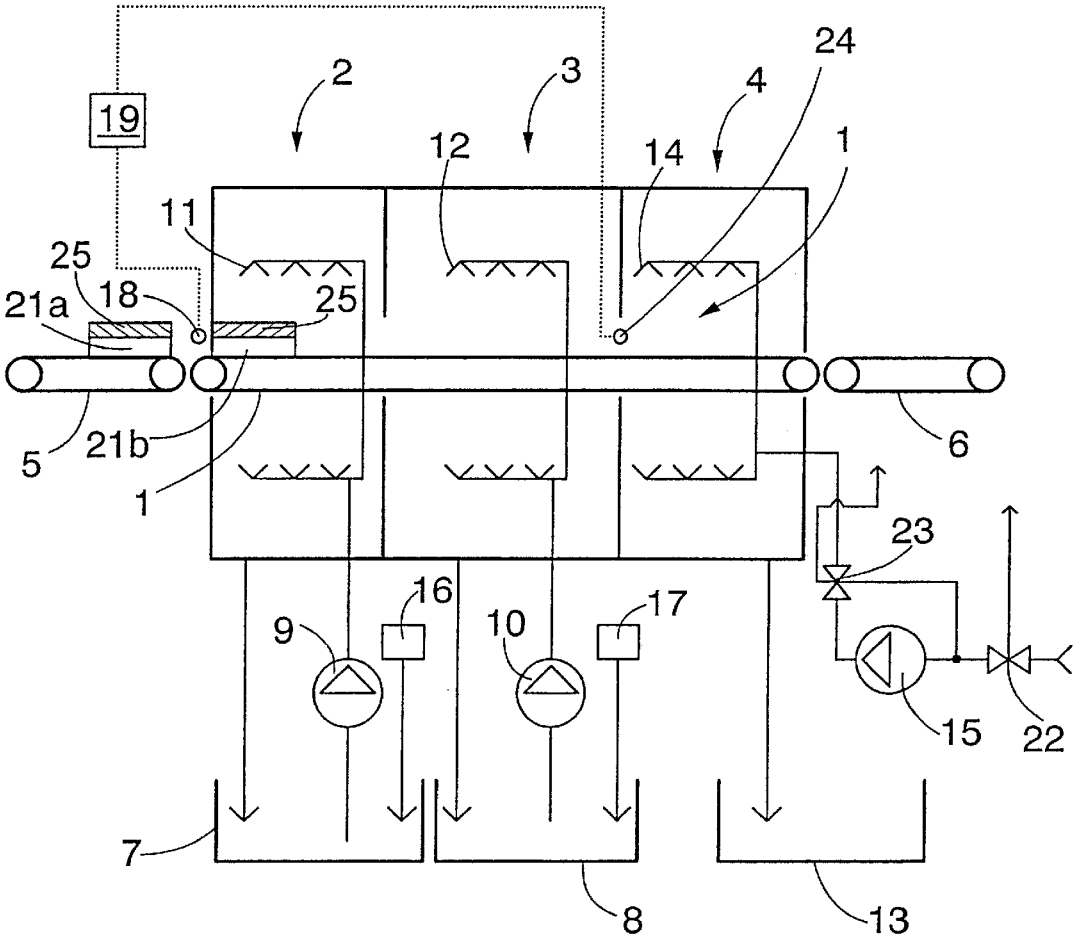

FIG. 1 shows a side view of an automated washing apparatus. The washing apparatus comprises a washing conveyor 1 conveying racks 21*a*, 21*b*, or similar items to be washed, through the washing apparatus. In the embodiment shown in the Figure, there are two different rack types, i.e. first racks 21*a* and second racks 21*b*. The racks 21*a*, 21*b* are for example standard size plastic racks into which the dishes are arranged. The racks 21*a*, 21*b* are provided with a sensor code 25 which allows the rack types to be identified. Each rack 21*a*, 21*b* is filled with dishes that require a similar wash: for example, vessels used in cooking and therefore usually containing impurities that are firmly stuck are placed into the rack 21*a*, whereas the second rack 21*b* will contain dishes from which the dirt comes off with a lighter wash. The number of racks meant for different kinds of dishes may naturally be more than two. The colour of the rack 21*a*, 21*b*, or on a part of it, is preferably used as the sensor code 25, because it will then be easy for the staff to identify the rack types and to place the dishes into the appropriate racks. The sensor code 25 may also be for example a bar code, an electromagnetic code or any other similar ID code known per se, or a combination of a plural number of codes.

The washing apparatus may comprise a prewash zone 2, followed by a main wash zone 3 and a rinsing zone 4. The washing apparatus is preceded by a feeder conveyor 5 bringing in the racks 21*a*, 21*b* and, correspondingly, followed by a discharge conveyor 6 at the outlet end. Moreover, the washing apparatus comprises containers 7 and 8, shown schematically, for storing the washing fluid for the prewash and the main wash and from where it is cycled by means of pumps 9 and 10 to both the zones separately in order to be sprayed onto the dishes to be washed by means of nozzles 11 and 12 provided in the pumps. Furthermore, it comprises a container 13 into which the water used for rinsing is collected from the rinsing zone 4, from where the used water is conveyed further to the washing zone. The rinsing zone is provided with nozzles 14 into which clean water is supplied for the rinsing by means of pumps 15. The washing apparatus further comprises containers 16 and 17 for feeding the necessary chemicals to the washing fluids used in the prewash and main wash zones.

The washing apparatus shown in the Figure comprises a conveyor 1, which is used for carrying the items through the prewash, the main wash and the rinsing zone. The speed of conveyance on the conveyor 1 is set so that both the operating costs and the rinsing result will be optimal. The rinsing zone and the other zones in the washing apparatus are dimensioned in such a way that a sufficient wash result will be obtained when the items travel through the apparatus.

According to a solution of a preferred embodiment of the invention, the inlet to the rinsing zone 4 is provided with a first sensor 24 which detects the rack 21*a*, 21*b* entering the rinsing zone and its type on the basis of the sensor code 25 on the rack. The sensor 24 can be implemented for example by means of machine vision devices or other sensor means based on optical recognition or on magnetism, or by using other sensors known per se. The first sensor 24 may also detect if a rack that has passed the sensor is not immediately followed by a new one, or a separate sensor, not shown in the Figure for the sake of clarity, may be used for this purpose.

The sensor 24 is connected to a control item 19. The control item 19 receives information from the sensor 24 on the basis of which the item selects an optimal rinse programme to the rinsing zone. The rinse programme is programmed into the control item 19 in a manner known per se, and the parameters it controls comprise for example conveyor speed, spraying time and cycles, and the amount of rinsing agent. This allows the operating costs arising from the use of clean water to be minimized, providing, however, a sufficient rinsing at the same time.

Moreover, the inlet to the washing apparatus may be equipped with a second sensor 18 identifying the type of the rack 21*a*, 21*b* entering the first zone in the washing apparatus, which in this case is the prewash zone 2. The second sensor 18 may also detect if the rack that has passed the sensor is not immediately followed by a new one, or a separate sensor may be used for this purpose. Similarly to the first sensor 24, the second sensor 18 is also connected to the control item 19. The control item 19 may be arranged to use the information to be received from the second sensor 18 for selecting the washing programme for the prewash zone 2 and the main wash zone 3, the programme being programmed into the control item 19 for washing the dishes in the rack to be washed in a desired manner, taking into account the wash result and the costs of operation. For example, dishes for which a lighter wash is sufficient may be taken through the washing zone at a higher speed, whereas very dirty dishes or those that are difficult to clean may be washed using a programme which takes the dishes slowly through the washing zone, or the programme may even pause occasionally. In addition, used washing water can be removed more effectively from the cycle of the washing zone 3 programme by supplying more rinsing water to the rinsing zone 4 than what is needed in the ongoing rinsing phase, which in turn allows a sufficient amount of new washing water to be obtained into the washing zone. In another embodiment the identifying data arriving from the second sensor 18 of the washing apparatus also controls the operation of the rinsing zone 4. In this case the first sensor 24 is not needed and can therefore be left out.

In another preferred embodiment, the washing apparatus is controlled in cycles, i.e. there is an operating period, during which the conveyor of the washing apparatus moves, and washing fluids and rinsing water is fed into the washing apparatus, and a pause period, during which the conveyance of the items is brought to a halt and the feeding of the rinsing water to the rinsing zone is interrupted. The operating period is dimensioned so that during the period the rack 21*a*, 21*b* to be washed travels a distance which is equal to half the length of the rack, or its manifold. Consequently, if the rack 21*a*, 21*b* that has entered the washing apparatus is not immediately followed by a new rack, the conveyor of the washing apparatus is halted and the entire wash cycle is interrupted until there is a new rack at the inlet to the washing apparatus. The inlet to the washing apparatus is provided with a sensor which is connected to the control item 19 to identify the type of the entering rack 21*a*, 21*b* in the manner described above. On the basis of the identification, the control item 19 selects the washing programme, and possibly a rinsing programme, meant for the rack type concerned. The washing programme is preferably programmed in such a way that the duration of the wash that takes place in the washing zone 3 is determined by the rinsing time of the previous rack 21*a*, 21*b*; it is not essentially significant if the wash lasts even longer than the optimal wash, the operating costs of the washing zone 3 are relatively low compared with the costs arising from the rinsing zone 4. The described discontinuous conveyor use based on operating periods and pause periods can naturally be also applied to fly type apparatuses.

The drawing and the related specification are only meant to illustrate the idea of the invention. The washing apparatus does not necessarily comprise a prewash zone at all, the prewash being then performed manually, for example. Another alternative is that prewash forms a fully separate phase, in which case it is separately controlled and may also be provided with a separate conveyor and rack type sensor. In addition, if necessary, the washing zone in the washing apparatus may be divided into more compartments than those shown in the Figure. The length of the zones 2, 3 and 4 may be substantially equal to the dimension of the rack 21*a*, 21*b*, whereby an individual wash can be easily subjected precisely to the item to be washed. The length of the zones 2, 3, 4 may also be equal to a half of a rack, or slightly longer, only one half of a rack being then washed or rinsed in the zone at a time.

What is claimed is:

1. A method for washing items in an automated washing apparatus comprising at least one conveyor, at least one washing zone and at least one rinsing zone, the method comprising:

guiding items to be washed in succession through a washing apparatus in the process direction of the apparatus and spraying with washing fluid in the washing zone and rinsing with water in the rinsing zone; and identifying different types of items to be washed, distinguishable from one another, using identifying sensors arranged to the washing apparatus, the result of the identification allowing a control item of the washing apparatus to automatically select at least one of the appropriate wash and rinse programme for the item.

2. A method according to claim 1, wherein the washing zones and rinsing zones share a common conveyor.

3. A method according to claim 1, wherein the washing apparatus is operated in cycles such that during an operating period, washing fluid and rinsing water are fed to the washing apparatus and the items to be washed are conveyed in the process direction of the apparatus, and during a pause period conveyance of the items is brought to a halt and feeding of rinsing water to the rinsing zone is interrupted.

4. A method according to claim 3, wherein the operating period is dimensioned so that during the period the item to be washed travels a distance which is equal to half the length of the item to be washed, or to its manifold.

5. A method according to claim 1, wherein the item to be washed comprises an identifier code from which the identifying sensors identify the type of the item to be washed.

6. A method according to claim 1, wherein wash parameters controlled by the wash programme compnse conveyor speed, spraying time and cycles.

7. A method according to claim 1, wherein the item to be washed is a rack into which dishes to be washed are placed.

8. A method according to claim 1, wherein the washing apparatus comprises a fly conveyor.

* * * * *